US008166619B2

(12) United States Patent
Cossutti et al.

(10) Patent No.: US 8,166,619 B2
(45) Date of Patent: May 1, 2012

(54) FLUID-TIGHT SLIDE FASTENER

(75) Inventors: Livio Cossutti, Mendrisio (CH); Marc Butz, Caslano (CH)

(73) Assignee: RIRI Group S.A. (CH)

( * ) Notice: Subject to any disclaimer, the term of this patent is extended or adjusted under 35 U.S.C. 154(b) by 980 days.

(21) Appl. No.: 11/861,611

(22) Filed: Sep. 26, 2007

(65) Prior Publication Data

US 2008/0083098 A1 Apr. 10, 2008

(30) Foreign Application Priority Data

Oct. 4, 2006 (EP) ..... 06020822

(51) Int. Cl.
*A44B 19/32* (2006.01)
*A44B 19/42* (2006.01)

(52) U.S. Cl. ..... 24/389; 24/403; 24/397; 24/398

(58) Field of Classification Search ..... 24/415, 24/389, 403, 392, 401, 391, 417, 428, 427, 24/431, 416, 585.1, 585.11, 585.12, 397, 24/398; 139/384 B, 420 R, 420 A; 425/814
See application file for complete search history.

(56) References Cited

U.S. PATENT DOCUMENTS

| | | | | |
|---|---|---|---|---|
| 2,400,924 | A | 5/1946 | Fite | |
| 3,490,109 | A * | 1/1970 | Heimberger | 24/389 |
| 3,714,698 | A | 2/1973 | Fukuroi | |
| 3,832,815 | A * | 9/1974 | Balaz et al. | 52/223.7 |
| 4,964,774 | A * | 10/1990 | Lat et al. | 411/446 |
| 5,172,456 | A | 12/1992 | Samberg et al. | |
| 5,310,792 | A * | 5/1994 | Inoue | 525/64 |
| 5,371,927 | A * | 12/1994 | Aussedat | 24/429 |
| 5,444,898 | A | 8/1995 | Norvell | |
| 5,500,276 | A | 3/1996 | Sawada et al. | |
| 5,654,369 | A * | 8/1997 | Tsubaki et al. | 525/205 |
| 5,763,077 | A * | 6/1998 | Inamura | 428/364 |
| 5,945,055 | A * | 8/1999 | Inamura | 264/210.5 |
| 6,105,214 | A | 8/2000 | Press | |
| 6,427,294 | B1 * | 8/2002 | Shibaike et al. | 24/398 |
| 6,562,902 | B1 * | 5/2003 | Fischer et al. | 525/78 |
| 6,607,995 | B1 | 8/2003 | Takeuchi et al. | |
| 7,073,538 | B2 * | 7/2006 | Bhatnagar et al. | 139/383 R |
| 7,181,810 | B2 * | 2/2007 | Fernando | 24/389 |

(Continued)

FOREIGN PATENT DOCUMENTS

CN 2348647 Y 11/1999

(Continued)

OTHER PUBLICATIONS

Office Action dated Feb. 18, 2011 in U.S. Appl. No. 12/233,114.

*Primary Examiner* — Robert J Sandy
*Assistant Examiner* — Rowland D Do
(74) *Attorney, Agent, or Firm* — Akerman Senterfitt

(57) ABSTRACT

A fluid-tight slide fastener including coated tapes equipped with teeth, opposite stops and a slider operable between the opposite stops to engage or disengage the teeth. The coated tapes include a core textile layer and a fluid-barrier coating made of a thermoplastic elastomer material (TPE), the teeth being made of a thermoplastic material. The textile material of the core layer of the coated tapes is chosen among polyester, polyamide and their blends or copolymers. The thermoplastic elastomer material of the coating is chosen between thermoplastic elastomer polyurethane (TPE-U) and thermoplastic elastomer polyester (TPE-E). The thermoplastic material of the teeth is chosen among PBT, ABS, polyamide and their blends or copolymers.

16 Claims, 2 Drawing Sheets

U.S. PATENT DOCUMENTS

| | | | | |
|---|---|---|---|---|
| 7,191,497 | B2 | 3/2007 | Butz | |
| 7,500,291 | B2 * | 3/2009 | Matsumoto | 24/389 |
| 7,565,722 | B2 * | 7/2009 | Kusayama et al. | 24/436 |
| 7,591,051 | B2 * | 9/2009 | Kusayama et al. | 24/387 |
| 7,790,807 | B2 * | 9/2010 | Brunner et al. | 525/147 |
| 7,870,649 | B2 * | 1/2011 | Mikuma et al. | 24/413 |
| 7,934,305 | B2 * | 5/2011 | Cossutti | 29/408 |
| 7,954,209 | B2 * | 6/2011 | Chen | 24/389 |
| 2004/0064922 | A1 | 4/2004 | Fernando | |
| 2004/0237266 | A1 | 12/2004 | Wang | |
| 2005/0220375 | A1 * | 10/2005 | Thomas et al. | 383/105 |
| 2006/0201571 | A1 * | 9/2006 | Stobbe | 139/426 R |
| 2006/0252621 | A1 * | 11/2006 | Howell et al. | 493/13 |
| 2006/0282995 | A1 * | 12/2006 | Liou | 24/389 |
| 2008/0269382 | A1 * | 10/2008 | Gerster et al. | 524/104 |
| 2009/0165265 | A1 * | 7/2009 | Chen | 24/389 |

FOREIGN PATENT DOCUMENTS

| | | | |
|---|---|---|---|
| WO | WO 93/07776 | A1 | 4/1993 |
| WO | WO 02/03825 | A1 | 1/2002 |

* cited by examiner

FLUID-TIGHT SLIDE FASTENER

FIELD OF APPLICATION

The present invention, in its most general aspect, refers to a slide fastener.

In particular, the invention refers to a fluid-tight slide fastener, i.e. a slide fastener that is impermeable to fluids.

In the following description, the term "fluid-tight" refers to a seal or material that is resistant to the passage of liquids, in particular water, and/or gases, for example air, even when put under a considerable pressure strain, for example a pressure difference between the interior and the exterior sides of a slide fastener of up to about 2 bars.

More in particular, the present invention refers to a fluid-tight slide fastener of the type comprising a pair of impermeable tapes, each tape having a layered structure comprising an inner layer of a reinforcing textile material strip and an outer layer of fluid barrier material enveloping said inner layer, each tape also comprising a row of aligned teeth on at least a portion of one of the long edges thereof, said rows of aligned teeth facing each other and being associated to opposite stops, and a slider slidable between said stops for engaging in a fluid-tight way or disengaging said aligned teeth respectively.

The expressions "reinforcing textile material" and "textile material" refer to a woven or non woven material obtained from fibers of materials which are suitable for and compatible with the requirements of the end products onto which the slide fastener is to be applied.

The present invention also refers to a process for manufacturing a fluid-tight slide fastener as above.

PRIOR ART

It is well-known in the art that slide fasteners comprise a pair of tapes of a textile material, each tape bearing a row of aligned teeth on at least a portion of one of the long edges thereof, said rows of aligned teeth facing each other and being associated to opposite stops, and a slider slidable between said stops for engaging or disengaging said aligned teeth respectively.

It is also known that in some sports and outdoor activity items, such as for example diving or sailing suits, camping tents and the like, slide fasteners are required to be fluid-tight, to prevent the passage of fluids, in particular water, across the two sides of the tapes of the slide fasteners, yet both tenacious and pliable, to a certain extent.

To this purpose, it is known to use multi-layered tapes composed of an inner layer of a reinforcing textile material enveloped in an outer fluid barrier material layer in such a way that none of the inner textile material is exposed to the surface, and to seal the aligned teeth on the outer fluid barrier material of the respective tapes so that the bonding which is formed between the teeth and the fluid barrier material is effectively fluid-tight.

More in particular, according to the prior art, a combination of a textile material for the inner layer of the tapes, a thermoplastic elastomer material (TPE) for the outer fluid-barrier layer of the tapes and a thermoplastic material for the teeth are used for the manufacture of said fluid-tight slide fasteners. In fact, these materials have proven to better meet most of the requirements that these products must satisfy, such as the above-mentioned impermeability and flexibility of the tapes, as well as their stability to light, resistance to sea water, and also easiness of sealing, gluing and stitching. Furthermore, such materials can be efficiently worked in extrusion processes by which the layered structure of the tapes is formed and in injection overmolding processes by which the teeth are sealed to the tapes.

However, although effectively fluid-tight at the teeth—outer barrier layer interface, slide fasteners of the above-described type exhibit a drawback in that they do not always show satisfactory mechanical properties, in particular at the interface between the inner layer and the outer layer of the tapes. In this respect, it is often observed that upon repeated exposure of said slide fasteners to various kinds of stresses deriving from their frequent and repeated use and/or from conventional washing operations, the layers of the tapes tend to separate from one another.

This separation process, known as delamination, which is mainly due to a non-satisfactory adhesion between the materials constituting the inner and the outer layers of the tapes, causes the tapes to weaken and the inner textile material to become exposed to the surface, thus compromising the fluid-tight nature of the tape itself.

Therefore, it would be desirable to provide a multi-layered fluid-tight slide fastener which is capable of withstanding repeated use without undergoing disruption of its structural integrity, in particular at the interface between the inner and the outer layers of the tapes, due to delamination of said layers, even after long and repeated use under harsh conditions of temperature, pressure, tear and tension.

SUMMARY OF THE INVENTION

The technical problem underlying the present invention is that of devising and providing a fluid-tight slide fastener of the type considered above, which is reliable in the long run with regard to its fluid-tight nature as well as its structural integrity, so as to overcome the mentioned drawbacks with reference to the prior art.

This problem is solved, according to the present invention, by a fluid-tight slide fastener comprising a pair of tapes, each tape having a layered structure comprising an inner reinforcing textile material layer enveloped in a fluid barrier layer made of a thermoplastic elastomer material (TPE), each tape exhibiting a row of aligned teeth made of a thermoplastic material on at least a portion of one of the long sides thereof, the rows of aligned teeth of said pair of tapes facing each other and being associated to top and bottom stops, and a slider slidable between said top and bottom stops for engaging in a fluid-tight way or disengaging said aligned teeth respectively, characterized in that said textile material for inner reinforcing layer of the tapes is chosen between polyester (PE), preferably polyethylene terephthalate (PET), polyamide (PA) and their blends or copolymers; said thermoplastic elastomer material for the fluid barrier material layer is chosen between a thermoplastic elastomer polyurethane (TPE-U) and thermoplastic elastomer polyester (TPE-E); and said thermoplastic material for the teeth is chosen among polybutylene terephthalate (PBT), acrylonitrile butadiene styrene (ABS), polyamide (PA) and their blends or copolymers.

The term "thermoplastic elastomer material (TPE)" indicates specific materials, known per se, having a hard phase and a soft phase which confer thermoplastic properties and elastomer properties (flexibility) respectively. It includes block copolymers as well as blends comprising a thermoplastic material and an elastomer material.

Preferably, said TPE-E is a polyether-ester block copolymer and said TPE-U is a block copolymer obtained from an ether and/or an ester and a isocyanate.

According to a preferred aspect of the invention, said thermoplastic material consists of a blend including PBT and polycarbonate (PC).

Preferably, the PBT/PC weight ratio in said blend ranges between 70/30 and 30/70.

According to another preferred aspect of the invention, said thermoplastic material consists of a blend including acrylonitrile butadiene styrene (ABS) and a polyamide (PA).

Preferably, the ABS/PA weight ratio in said blend ranges between 70/30 and 30/70.

According to another aspect of the invention, the materials constituting the fluid barrier layer of the tapes and the teeth may include suitable additives such as, for instance fillers, pigments, binders and/or compatibilizers, the latter being incorporated to improve the physical and chemical affinity between said materials and/or between the materials used for the layered structure of the tape.

According to a more preferred aspect of the invention, a fluid barrier layer of TPE-E is chosen in combination with teeth made of PBT. According to a further aspect of the invention, a fluid barrier layer of TPE-U is chosen in combination with either a blend of ABS and PA or a blend of PBT and polycarbonate PC.

It was surprisingly found that slide fasteners manufactured by using the selected materials have good mechanical properties at both the interface between the layers of the tapes and the chemical bonding between the fluid barrier layer of the tape and the teeth.

In particular, it was found that by using the selected materials for the inner textile material layer and the outer fluid barrier material layer of the tapes, the layers are capable of reaching optimal values of adhesion to each other that are sufficient for withstanding the normal transfer of traction and shear forces through the contact interface which the slide fasteners are subjected to during their repeated use. At the same time, the thermoplastic elastomer material constituting the outer layer of the tapes confers a good flexibility to the tapes and exhibits a good adhesion by chemical bonding with the thermoplastic material constituting the teeth.

Without wishing to be bound by theory, it is thought that this improved adhesion between the selected materials of this invention is given by their physico-chemical affinity, as well as by the creation of strong chemical bonds at the surface of the materials to be joined in the operating conditions normally used for the manufacture of the tapes by extrusion and for the bonding between the tapes and the teeth by injection overmolding.

According to another inventive feature, said inner reinforcing textile material layer of the tapes is made with a spun yarn of cut fibers.

The textile material of the inner reinforcing layer surface, according to this feature of the invention, has an irregular, rough surface due to the use of cut fibers. More in detail, the ends of the cut fibers may protrude from the ideal diameter of the yarn, or the same fibers may form loops protruding from said diameter. This results in an irregular, non-smooth surface of the yarn, similar to natural-fiber yarns, while on the contrary common artificial or synthetic fibers yarns have a smooth surface.

As known in the art, natural textile materials such as cotton have short fibers, each fiber typically having a length of a few centimeters, while artificial or synthetic fibers are available with continuous fibers. According to the invention, cut fibers of selected artificial or synthetic textile material are used for the textile material of the inner layer, said fibers being obtained preferably by a cutting process, to imitate the surface of natural yarns.

It has been surprisingly found that a fastener with such inner textile layer has improved resistance to delamination. It is considered that improved resistance to delamination is due to said irregular, rough surface of the yarn, giving a stronger coupling with the fluid-barrier layer. More in particular, it has been found that ends or loops of the fibers, protruding from the ideal diameter of the yarn, remain embedded in the thermoplastic elastomer material of the fluid-barrier layer enhancing the resistance to delamination.

In a preferred embodiment, said thermoplastic elastomer material is coupled to the textile layer in a melted state, and the above effect is obtained, i.e. irregularities of the surface remain trapped and embedded in the material of the fluid-barrier layer, thus yielding stronger coupling between the layers and improved resistance to delamination.

According to another preferred aspect of the invention, the slide fastener further comprises a layer of an adhesive between the inner textile material layer and the outer fluid-barrier material layer of the tapes. In this way, the inner textile material layer and the outer fluid-barrier material are joined through a bonding occurring essentially between each of said materials and the molecules of the adhesive. Advantageously, the adhesive can be selected so as to have a high physico-chemical affinity for both the materials to be joined.

Preferably, the adhesive comprises a polyurethane resin.

The present invention further relates to a process for manufacturing slide fasteners as described above. This process comprises the steps of:

providing a plurality of strips of a textile material, covering said strips of a textile material with a layer of a fluid-barrier material, applying a plurality of sets of aligned teeth to each coated strip along a longitudinal edge thereof, heat cutting each coated strip transversally along consecutive sets of aligned teeth to obtain a plurality of tapes of the desired lengths wherein each tape is equipped with a set of aligned teeth, coupling said plurality of tapes in pairs and equipping each pair of tapes with top and bottom stops, and a slider slidable between said top and bottom stops, the process being characterized in that said textile material is chosen among polyester (PE), preferably PET, polyamide (PA) and their blends or copolymers; said fluid-barrier material consists of a thermoplastic elastomer material (TPE) chosen between a thermoplastic elastomer polyurethane (TPE-U) and a thermoplastic elastomer polyester (TPE-E); and said teeth are made of a thermoplastic material chosen among polybutylene terephthalate (PBT), acrylonitrile butadiene styrene (ABS), polyamide (PA) and their blends or copolymers.

Preferably, the covering step is performed by extrusion or by lamination of the selected TPE onto the strips of textile material.

Preferably, said teeth are obtained by injection overmolding of the selected thermoplastic material onto said longitudinal edge of each coated strip.

Preferably, the process of the invention further comprises the step of sealing each tape at its short cut edge(s) with said fluid-barrier material. This may be carried out for instance while heat cutting said coated strips or by covering said short cut edge(s) with "fresh" fluid-barrier material.

According to another aspect of the invention, said strips of a textile material are made with a spun yarn of cut fibers of an artificial or synthetic textile material, said fibers being obtained with a cutting process of continuous fibers, said yarn having natural fiber-like surface, i.e. an irregular, rough surface similar to those of yarns made of natural fibers.

According to still another aspect of the invention, said covering step is performed by extrusion or lamination of a selected TPE onto said spun yarn textile material of the strips, said TPE being in a melted state, so that the surface irregularities of the textile material remain embedded in the TPE layer.

According to another aspect of the present invention, said process further comprises the step of applying an adhesive layer onto the opposite surfaces of each textile material strip prior to covering said strips with said fluid-barrier material. The adhesive application is preferably carried out by soaking each textile material strip in a dispersion of the selected adhesive in an organic solvent or by spraying said adhesive dispersion onto the opposite surfaces of each textile material strip.

The adhesive is then activated during the covering step of the textile material strips with a fluid-barrier material layer, which is performed for instance by extrusion.

Further advantages and characteristics of the slide fasteners according to the inventions will be more evident from the detailed description and examples provided here below, given as indicative and not limiting purpose.

DETAILED DESCRIPTION OF PREFERRED EMBODIMENTS

Figure 1:
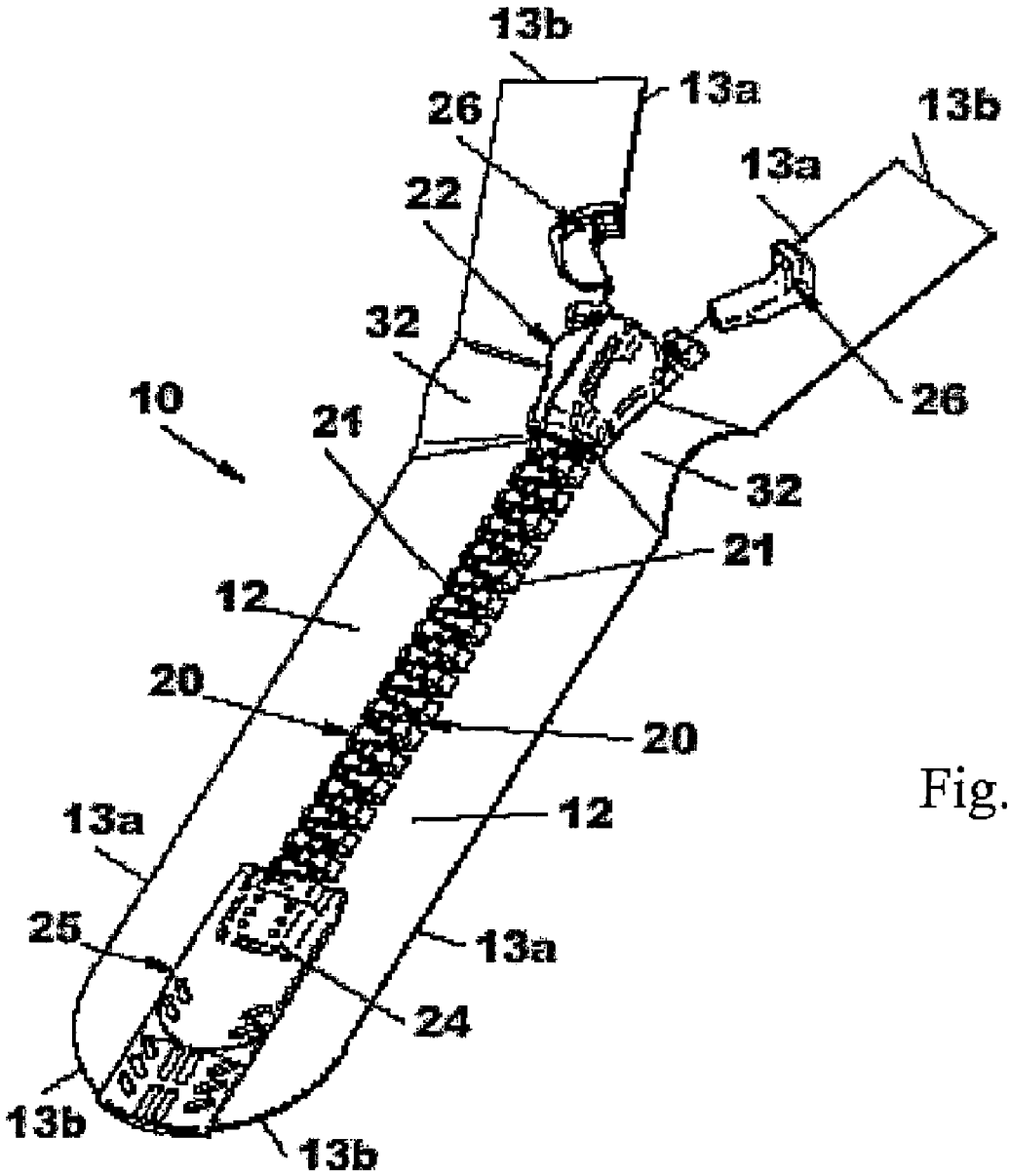
FIG. 1 schematically represents a perspective view of a fluid-tight slide fastener according to an embodiment of the present invention.
Figure 2:
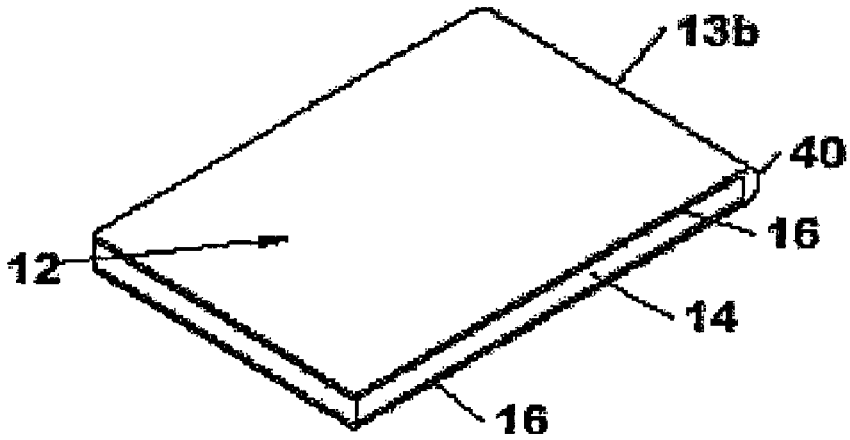
FIG. 2 schematically represents an enlarged perspective view of a detail of the slide fastener of FIG. 1 showing the layers of the tape.

With reference to FIGS. 1 and 2, a fluid-tight slide fastener is shown, in accordance with an embodiment of the present invention and globally indicated with 10.

The slide fastener 10 comprises a pair of tapes 12, substantially parallel to each other, each tape 12 being equipped with a row 20 of aligned teeth 21 on a central portion of the inner long edge 13*a* thereof, in a conventional manner, for example through injection overmolding processes.

In particular, said rows 20 of aligned teeth 21 face each other and are associated to two stops, namely a bottom stop 24 and a top stop 26, positioned at a set distance from each other along said row of aligned teeth. A slider 22 is slidable between the bottom stop 24 and the top stop 26, for engaging in a fluid-tight way or disengaging the aligned teeth 21 of said rows 20, respectively. In particular, the slider 22 comes to the end of its opening stroke at the bottom stop 24, thereby disengaging the aligned teeth 21 of said rows 20 whereas the slider 22 comes to an end of its closing stroke at the top stop 26 thereby engaging in a fluid-tight way the opposite aligned teeth 21 of said opposite sets 20.

In the FIGS. 1 and 2, the bottom stop 24 is in form of a single piece applied on both the tapes 12 at the lower ends of the rows 20 of aligned teeth 21, whereas the top stop 26 comprises two half-portions, each half-portion being applied on a respective tape 12 at the upper end of the respective set 20 of aligned teeth 21.

The application of the top stop 24 and the bottom stop 26 to the tapes 12 can be carried out in a per se conventional manner for example through injection molding.

Furthermore, the tapes 12 are joined in a fluid-tight way along a portion 25 of the respective inner long edges from the rows 20 of aligned teeth 21 and comprising the bottom stop 24. In particular, with reference to FIG. 1, on the external side of the slide fastener 10 (the external side being the side that is exposed to fluids during use) the portion 25 extends from the lower ends of said rows 20 of aligned teeth 21 up to the lower short edges 13*b* of the tapes.

As shown in FIG. 2, each tape 12 comprises an inner reinforcing textile material layer 14 enveloped in an outer fluid barrier material layer 16. The tape 12 is formed by either extrusion techniques or lamination and the fluid barrier material layer 16 entirely covers the inner textile material layer 14 so that no part of the inner textile material 14 remains exposed.

In accordance with the present invention, said inner textile material layer 14 is made of fibers of PE, preferably PET, PA or their blends or copolymers and said fluid barrier material layer 16 is made of a thermoplastic elastomer material chosen between TPE-E and TPE-U.

Said inner textile material 14, made out of woven or non-woven fibers, confers the tape a certain degree of pliability. It is important, in fact, that the slide fastener can be bent and adapted to the shape of the item onto which it is applied without it cracking, snapping or otherwise getting damaged or generating an encumbrance to the item onto which it is applied.

In accordance with a preferred embodiment, said textile material 14 made of spun yarns of cut fibers of an artificial or synthetic textile material. Said yarn has an irregular, rough natural-like external surface, due to the use of cut fibers.

Furthermore, said outer fluid barrier material layer 16 is fully compatible with the inner textile material layer 12 so that, upon manufacture by extrusion or lamination, the two layers undergo an interaction which brings about a strong and solid adhesion between them.

In accordance with the present invention, said aligned teeth 21 of the rows 20 are made of a thermoplastic material chosen among polybutylene terephthalate (PBT), acrylonitrile butadiene styrene (ABS), polyamide (PA) and their blends or copolymers.

In this way, the material of the aligned teeth 21 is fully compatible with the material of said outer fluid barrier material 16, so as to form a fluid-tight seal upon application of a set 20 of aligned teeth 21 on an edge of said tape 12 for example through overmolding processes.

Figure 3:
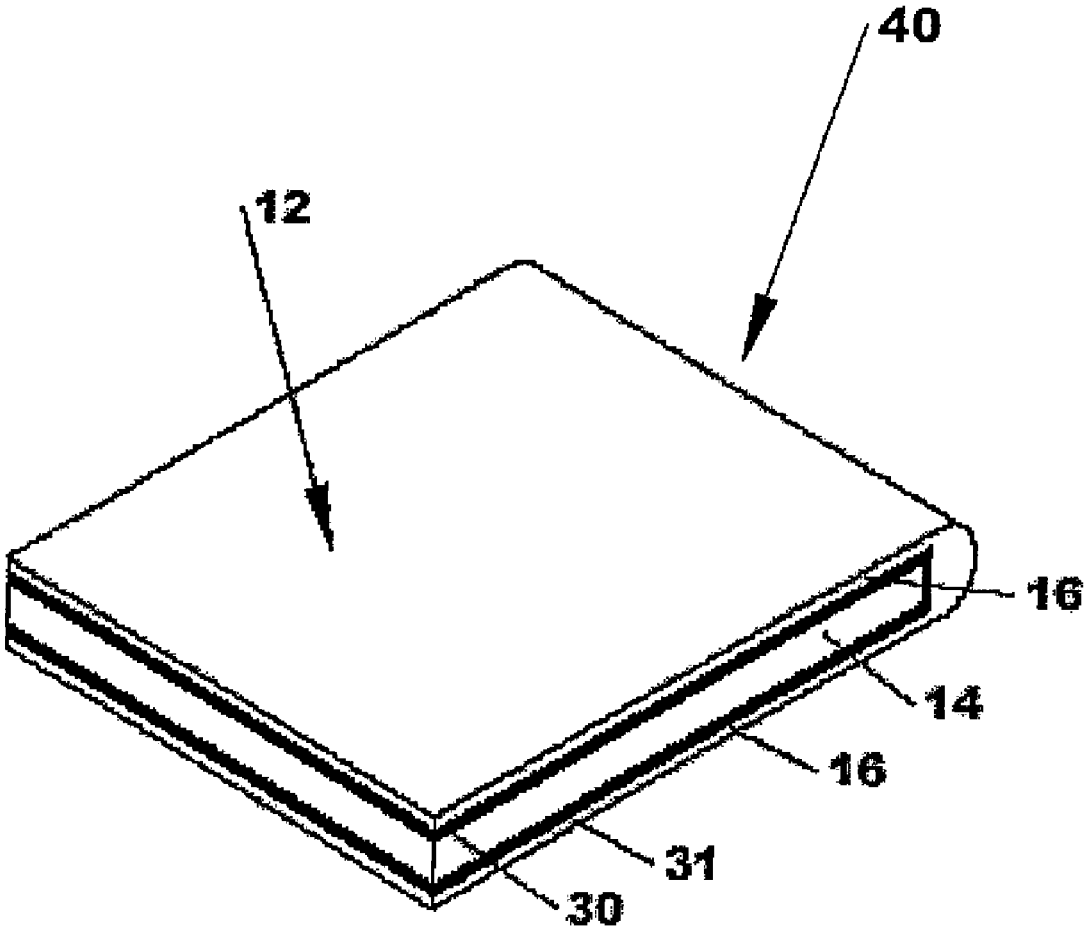
FIG. 3 schematically represents an enlarged perspective view of a detail of a slide fastener showing the layers of the tape, according to a further embodiment of the present invention.

FIG. 3 shows a detail of a slide fastener, globally indicated with 40, according to a further embodiment of the present invention.

In this figure, features of the slide fastener 40 structurally or functionally equivalent to those of the slide fastener 10 of FIGS. 1 and 2 are denoted with the same reference number.

In the slide fastener 40, each tape 12 comprises an inner reinforcing textile material layer 14 enveloped in an outer fluid barrier material layer 16 which entirely covers the inner textile material layer 14 so that no part of the inner textile material 14 remains exposed. However, in this embodiment of the invention, the tape 12 also includes two layers of an adhesive (layers 30 and 31) applied on the opposite (top and bottom) surfaces of the textile material layer 14. In the areas where the adhesive is present, the textile material layer 14 and the fluid-barrier material layer 16 are then joined indirectly by a strong chemical bonding between the adhesive molecules and the materials constituting the textile layer 14 and the fluid-barrier layer 16, which allows to avoid delamination of said layers 14 and 16.

The followings are non-limiting examples for the manufacture of slide fasteners according to the invention.

Example 1

Strips of PE fibers were fully coated with a layer of fluid-barrier material (a TPE-U material) by means of a conventional extrusion head. The extrusion of the fluid-barrier material from said head was performed in a conventional way according to the procedure suggested by the manufacturer.

The coated strips were then equipped each with a plurality of rows of aligned teeth along a longitudinal edge thereof, said rows being set at a predetermined distance to each other. The teeth were each made from a blend of ABS and PA. The teeth application was performed by injection overmolding the teeth material onto said longitudinal edge of the coated strips in a conventional way (according to the procedure suggested by the manufacturer). The coated strip equipped with said rows of aligned teeth were then heat cut transversally along consecutive rows of aligned teeth to obtain a plurality of tapes of the same dimensions, wherein each tape was equipped with a row of aligned teeth.

Then, in a conventional way, the tapes were sealed with said fluid barrier material at their short edge(s) that had remained uncoated. A plurality of slide fasteners according to invention was then obtained each from a pair of such tapes through a succession of further conventional steps among which the steps of equipping each pair of tapes with top and bottom stops and a slider running between said stops.

The slide fasteners so obtained were tested for their resistance to delamination of the layered structure of the tapes before and after each of repeated washing cycles (up to five washing cycles).

Each washing cycle of the slide fasteners was carried out in a conventional washing machine at a temperature of 40° C. for about 1 hour and 30 minutes using appropriate detergents.

The resistance tests were carried out as follows. Each sample to be tested was engraved on its surface so as to peel (raise) a small rectangular portion (about 15×40 mm) of the said fluid-barrier layer from the respective tape. Then, the small rectangular portion of the fluid-barrier layer and a free end portion of the tape (in the direction opposite to that of peeling) were clamped in two opposite flat clamps of a dynamometer respectively and the sample was put perpendicularly to the flat clamps.

Afterwards, a clamp was moved away from the other clamp at a constant rate so subjecting the sample to traction with increasing loads. The test was ended with the determination of the minimum load (in Kg) necessary to obtain delamination (separation) of the fluid-barrier layer from the tape.

In particular, the samples of slide fasteners according to the invention were divided in two groups according to the position on the tape surface where engraving and peeling had been carried out.

The results are shown in the following table 1 as a mean of minimum load values obtained from tested samples of the respective groups.

TABLE 1

| Minimum load (in Kg) necessary to obtain delamination | | | | | | |
|---|---|---|---|---|---|---|
| Samples | Before washing cycles | After 1st washing cycle | After 2nd washing cycle | After 3rd washing cycle | After 4th washing cycle | After 5th washing cycle |
| ($1^{st}$ group) | 1.6 | 1.4 | 1.4 | 1.3 | 1.3 | 1.1 |
| ($2^{nd}$ group) | 1.3 | 1.3 | 1.3 | 1.3 | 1.2 | 1.1 |

As can be seen from the above table 1, the slide fasteners of the invention exhibit a good resistance to delamination for the layered structure of the tapes, even after repeated washing cycles, In particular, it can be observed that the resistance to delamination of slide fasteners of the invention only decays slightly as the number of washing cycles increases.

The above results proves that, according to the invention, a very good bonding has been achieved between the inner textile material and the outer fluid-barrier material and that such a bonding can be retained substantially unaltered over time. As a consequence, the slide fasteners according to the invention are able to retain their fluid-tight characteristics in the long run upon repeated exposure to tensile stresses deriving for instance from their frequent and repeated use and upon conventional washing operations.

With regard to the teeth, the slide fasteners of the invention also exhibit good mechanical properties at the interface with the tapes which are fully comparable to those of conventional slide fasteners, thereby proving that the present invention also achieves a good chemical bonding between the teeth material and the outer fluid-barrier material of the tapes.

Example 2

A plurality of slide fasteners were manufactured using the same procedure disclosed in example 1. However, in this example, the fluid barrier material covering the strips of textile material was made of TPE-E including yellow pigments and the material for the teeth was PBT.

The slide fasteners so obtained were tested for their resistance to delamination of the layered structure of the tapes using the same procedure discussed above in example 1. However, in this example, all samples according to the invention to be tested were engraved substantially at the same position on the tape surface.

The results are shown in the following table 2 as a mean of minimum load values obtained from tested samples.

TABLE 2

| Minimum load (in Kg) necessary to obtain delamination | | | | | | |
|---|---|---|---|---|---|---|
| Samples | Before washing cycles | After 1st washing cycle | After 2nd washing cycle | After 3rd washing cycle | After 4th washing cycle | After 5th washing cycle |
| | 1.5 | 1.3 | 1.3 | 1.2 | 1.0 | 1.0 |

As can be seen from the above table 2, the slide fasteners of the invention exhibit a good resistance to delamination for the layered structure of the tapes, even after repeated washing cycles. Again, it can be observed that the resistance to delamination of slide fasteners of the invention only decays slightly as the number of washing cycles increases.

Again, the above results proves that, according to the invention, a very good bonding has been achieved between the inner textile material and the outer fluid-barrier material and that such bonding can be retained substantially unaltered over time.

As a consequence, the slide fasteners according to the invention are able to retain their fluid-tight characteristics in the long run upon repeated exposure to tensile stresses deriving for instance from their frequent and repeated use and upon conventional washing operations.

With regard to the teeth, the slide fasteners of the invention also exhibit good mechanical properties at the interface with the tapes which are fully comparable to those of conventional slide fasteners, thereby proving that the present invention also achieves a good chemical bonding between the teeth material and the outer fluid-barrier material of the tapes.

Example 3

In this example, slide fasteners were prepared by using an adhesive for bonding the layers of the tapes.

In particular, it was carried out a variant of the procedure discussed above in example 1 according to which an adhesive layer (polyurethane resin) was first applied on the opposite surfaces of strips of PE, by soaking the strips in an adhesive dispersion, and then the strips provided with the adhesive were covered with a TPE-U fluid-barrier layer according to the procedure of example 1.

The procedure of example 1 was also followed after coating the strips, thereby obtaining a plurality of slide fasteners which were tested for their resistance to delamination of the layered structure of the tapes.

It was found that, thanks to the presence of adhesive in-between, the fluid-barrier layer and the textile layer of the respective tape were bonded extremely strong to each other and as a result no delamination of such layers was observed both before and after each of repeated washing cycles.

In particular, in any case, the fluid-barrier layer and the textile layer of the respective tape were found to be so strongly bonded to each other that it was not possible to raise any portion of the fluid-barrier layer for performing the tests in accordance with the procedure of example 1.

Again, the mechanical properties of the teeth have been found to be fully comparable with those of the prior art slide fastener teeth, thereby proving that in the manufacturing example according to the invention a good chemical bonding between the teeth material and the outer fluid-barrier material of the tapes has been achieved as well.

Example 4

A yarn is produced by a conventional spinning method, with polyester fibers which have been previously cut to obtain natural-like short fibers. The yarn so obtained has an irregular, rough surface, similar e.g. to a "pile" textile material, which imitates a natural-fiber yarn.

Said yarn is used for making the textile reinforcing layer, which is fully coated with a layer of melted TPE-U by means of a conventional extrusion head and according to example 1.

From the previous description it can clearly be seen that the fluid-tight slide fastener according to the present invention solves the technical problem, mostly by the fact that it exhibits good fluid-tight characteristics even in the long run, as the tapes are resistant to delamination.

Furthermore, the slide fastener of the invention features many advantageous characteristics, including: good flexibility, low brittle temperature (about −40° C.), performance stability in air in the temperature range of −30 to +70° C., ease of coloring, water resistance (low hygroscopicity), resistance to sea water, and chemicals such as petrol or ammonia, visible and UV light stability, and ease of sealing, gluing and stitching.

Of course, a person skilled in the art can bring numerous modifications and variants to the fluid-tight slide fastener described above in order to satisfy specific and contingent requirements, all of which are in any case covered by the scope of protection of the present invention, as defined by the following claims.

The invention claimed is:

1. A fluid-tight slide fastener comprising:

a pair of tapes, each tape having a layered structure comprising an inner reinforcing layer enveloped in a fluid barrier layer made of a thermoplastic elastomer material (TPE), each tape having a row of aligned teeth made of a thermoplastic material on at least a portion of one of the long sides thereof, the teeth being applied to coated tapes formed by said inner layer and fluid barrier layer, the rows of aligned teeth of said pair of tapes facing each other and being associated to top and bottom stops; and a slider slidable between said top and bottom stops for engaging in a fluid-tight way or disengaging said aligned teeth respectively, wherein said inner reinforcing layer is made of a material selected from the group consisting of polyester (PE), polyethylene terephthalate (PET), and their blends or copolymers, the material comprising spun yarn including cut fibers that is formed into a textile material having an irregular surface;

wherein said fluid barrier layer is made of a thermoplastic elastomer material (TPE) selected from the group consisting of polyurethane (TPE-U) and thermoplastic elastomer polyester (TPE-E), and wherein said teeth are made of a thermoplastic material selected from the group consisting of polybutylene terephthalate (PBT), acrylonitrile butadiene styrene (ABS), and their blends or copolymers, wherein the fluid barrier layer is bonded to the inner reinforcing layer by melting, such that the cut fibers forming the irregular surface of the inner reinforcing layer are embedded in the TPE material of the fluid barrier layer.

2. The fluid-tight slide fastener according to claim 1, wherein said TPE is TPE-E, and said thermoplastic material is comprises polybutylene terephthalate (PBT) and its blends or copolymers.

3. The fluid-tight slide fastener according to claim 2, wherein said TPE-E is a polyether-ester block copolymer.

4. The fluid-tight slide fastener according to claim 1, wherein said TPE is TPE-U obtained from an ether and/or an ester and an isocyanate.

5. The fluid-tight slide fastener according to claim 1, wherein said thermoplastic material consists of a blend including PBT and polycarbonate (PC).

6. The fluid-tight slide fastener according to claim 5, wherein the PBT/PC weight ratio in said blend ranges between 70/30 and 30/70.

7. The fluid-tight slide fastener according to claim 1, wherein said thermoplastic material consists of a blend including acrylonitrile butadiene styrene (ABS) and a polyamide (PA).

8. The fluid-tight slide fastener according to claim 7, wherein the ABS/PA weight ratio in said blend ranges between 70/30 and 30/70.

9. The fluid-tight slide fastener according to claim 1, further comprising a layer of an adhesive between the inner layer and the outer fluid-barrier material layer.

10. The fluid-tight slide fastener according to claim 9, wherein said adhesive comprises a polyurethane resin.

11. The fluid-tight slide fastener according to claim 10, wherein said adhesive comprises a dispersion of said polyurethane resin in an organic solvent.

12. A process for manufacturing fluid-tight slide fasteners, comprising the steps of:

providing a plurality of strips of a textile material, covering said strips of textile material with a layer of a fluid-barrier material to form a plurality of tapes each comprising an inner reinforcing layer formed of said textile material enveloped in said fluid-barrier material, applying a row of aligned teeth to each coated strip along a longitudinal edge thereof, the teeth being made of a thermoplastic material, heat cutting each coated strip transversally along consecutive sets of aligned teeth to obtain a plurality of tapes of the desired lengths wherein each tape is equipped with a set of aligned teeth, coupling said plurality of tapes in pairs such that the rows of aligned teeth of each pair of tapes face each other, and equipping each pair of tapes with top and bottom stops, and a slider slidable between said top and bottom stops for engaging in a fluid-tight way or disengaging said aligned teeth, wherein said inner reinforcing layer is selected from the group consisting of polyester (PE), polyethylene terephthalate (PET), and their blends or copolymers;

wherein said fluid-barrier material is made of a thermoplastic elastomer material (TPE) selected from the group consisting of a thermoplastic elastomer polyurethane (TPE-U) and a thermoplastic elastomer polyester (TPE-E), wherein said teeth are made of a thermoplastic material selected from the group consisting of polybutylene terephthalate (PBT), acrylonitrile butadiene styrene (ABS), and their blends or copolymers, wherein said covering step is performed by extrusion or lamination of the selected TPE onto the strips of textile material, and wherein said strips of textile material are made with a spun yarn of cut fibers, said fibers obtained with a cutting process of continuous fibers, said yarn having an irregular, rough external surface due to the use of said cut fibers, and wherein said covering step is performed by extrusion or lamination of the selected TPE onto said strips of textile material of the strips, said TPE being in a melted state, so that surface irregularities of said textile material remain embedded in the TPE layer.

13. The process according to claim 12, wherein said teeth are obtained by injection overmolding of the selected thermoplastic material onto said longitudinal edge of each coated strip.

14. The process according to claim 12, further comprising the step of sealing each tape at its short cut edge(s) with said fluid-barrier material.

15. The process according to claim 12 further comprising the step of applying an adhesive layer onto the opposite surfaces of each strip before covering said strips with said fluid-barrier material.

16. The process according to claim 15, wherein said covering step is performed by soaking each textile material strip in a dispersion of the selected adhesive in an organic solvent or by spraying said adhesive dispersion onto the opposite surfaces of each textile material strip.

* * * * *